US006076240A

United States Patent [19]

Henzler

[11] Patent Number: 6,076,240

[45] Date of Patent: Jun. 20, 2000

[54] LOCKING SNAP-FASTENER AND ITS RELEASING DEVICE

[75] Inventor: Bernd Henzler, Erkrath, Germany

[73] Assignee: YKK Corporation, Tokyo, Japan

[21] Appl. No.: 09/118,970

[22] Filed: Jul. 20, 1998

[30] Foreign Application Priority Data

Jul. 21, 1997 [DE] Germany ..... 197 31 207

[51] Int. Cl.[7] ..... A44B 17/00

[52] U.S. Cl. ..... 24/662; 24/661

[58] Field of Search ..... 24/621, 622, 623, 24/663, 662, 629, 580, 604, 605, 93, 94, 101 R, 101 B, 681, 671–676

[56] References Cited

U.S. PATENT DOCUMENTS

| | | | |
|---|---|---|---|
| 1,831,295 | 11/1931 | Fenton | 24/621 |
| 1,873,370 | 8/1932 | Ford | 24/621 |
| 3,107,408 | 10/1963 | Huelster et al. | 24/621 |
| 3,349,451 | 10/1967 | Maeno | 24/621 |
| 3,869,766 | 3/1975 | Raymond | 24/662 X |
| 4,539,735 | 9/1985 | Kasai | 24/621 |
| 4,562,624 | 1/1986 | Kanzaka | 24/623 X |
| 4,847,959 | 7/1989 | Shimada et al. | 24/662 X |
| 5,189,768 | 3/1993 | Riceman et al. | 24/662 X |
| 5,722,130 | 3/1998 | Baader | 24/662 |

*Primary Examiner*—James R. Brittain
*Assistant Examiner*—Robert J. Sandy
*Attorney, Agent, or Firm*—Hill & Simpson

[57] ABSTRACT

A snap-fastener having a male member and a female member, respectively having a cap with a rivet shaft piercing through a sheet member and a male part or a female part. The rivet shaft is inserted into an insertion hole so that an inner edge of a hole of the sheet member is sandwiched to have a seal portion. The male part has an engaging projection projecting outwardly at an end of a cylindrical engaging portion. The female part has a resilient engaging member urged axially inwardly and placed outwardly in diameter direction with respect to the engaging portion. The resilient engaging member has at least a locking projection projecting inwardly in diameter direction. The locking projection engages with the engaging projection to lock it so as to restrict its axial movement at the time of engagement between the male part and the female part. In order to disengage this locking, an exclusive device is used for moving the locking projection of the resilient engaging member outwardly in diameter direction.

16 Claims, 3 Drawing Sheets

LOCKING SNAP-FASTENER AND ITS RELEASING DEVICE

BACKGROUND OF THE INVENTION

1. Field of the Invention

The present invention relates to a snap-fastener, and more particularly to a snap-fastener having locking mechanism so that a male member and a female member do not disengage accidentally.

2. Description of the Related Art

With a known snap-fastener of this type (German Patent No. 3742007C1), an engaging portion of a male member extends forwardly at an acute angle with respect to an axis of the snap-fastener, while a corresponding portion of a female member extends similarly diagonally but along the axis. The engaging portion and the corresponding portion are temporarily resiliently deformed merely by pressing male and female parts against each other, thus they are engaged. The both member of the snap-fastener can be separated in the same manner.

Another type of snap-fastener is disclosed in Japanese Laid-Open Publication No. Hei 7-42327. According to this publication, with locking elements disposed movably in a central engaging space toward the axis in the female part, a male member is secured to a female member. The locking elements are composed of a pair of halves and a resilient member bridging ends of the halves, and the halves are normally urged to close to each other by the resilient member. In the middle of the halves, there provided projections in a shape of isosceles triangle in a plan view, slanting surfaces of which are urged to close to each other. The male member is prevented from being released from the female member, with the two halves contacting a neck of an engaging head of the male member at its under side, while being locked. When an opening device if inserted toward the slanting surfaces of the projections, the projections are moved outwardly against the resiliency of the resilient members. A gap between the halves becomes greater than the diameter of the engaging heads due to the movement, thus locking between the male part and the female part are released so that the male and female parts can be disengaged.

As described above, the conventional snap-fasteners have defect that the male and female parts can be disengaged easily by any person. With the locking snap-fasteners disclosed in the foregoing publications, their structures are relatively complicated which means high manufacturing cost, and further due to the locking element having the foregoing structure, the required space would necessarily be large and the snap-fastener would be voluminous as a whole.

SUMMARY OF THE INVENTION

Therefore, an object of the invention is to provide a snap-fastener having locking mechanism, in which a male part and a female part can be fixedly engaged easily and smoothly without increasing their volume nor occupying space, and further they can be disengaged only under predetermined conditions.

In the snap-fastener according to the invention, a resilient engaging member of the female part is fitted in a groove formed in a periphery of the female part from outside. The resilient engaging member has at least a locking projection which projects inwardly in diameter direction. An engaging projection of the male part engages with the locking projection so that an axial movement of the engaging projection is restricted. By urging the resilient engaging member in diameter direction in order to release the male part, the locking projection is resiliently movable outwardly.

The snap-fastener of the invention can easily be brought into engagement, but can not be disengaged by any person other than those who concerned. In order to disengage, it is necessary for the operator to know the engagement structure and to operate smoothly. Therefore, the persons who can easily disengage the male and female parts are limited to those who can use a necessary releasing device.

In an preferred embodiment of the invention, the groove formed in the periphery of the female part extends along almost entire periphery of the female part, having a width enough to insert the resilient engaging member therein. The resilient engaging member is inserted in the groove and guided toward an axis of the snap-fastener. The resilient engaging member is composed of an annular spring with a part open. The annular spring has the at least one locking projection projecting inwardly in diameter direction. At least a slit is formed in the groove for the locking projection to project through and from the inner peripheral surface of a male-part-engaging portion toward the axis.

The present invention is based on an understanding that the engaging portion of the female part defining or surrounding the groove is formed to be strongly integral at its bottom portion, therefore, for the resilient engaging member which absorbs an axial force in the locked condition to transmit the force outwardly in diameter direction, it is only necessary to provide the groove outwardly open in the outer periphery of the engaging portion. The slit is formed only locally, thus it does not mean to weaken the bottom part of the groove. Moreover, it also serves to align the annular spring with the female part.

In another preferred embodiment of the invention, it is preferable that the annular spring has two of the above-described locking projections. And the engaging projections of the male part are provided in confronting relationship, each projection being engaged with the corresponding locking projections. These two locking projections realize reliable engagement between the male and female parts without incurring extra costs.

It is preferable that the engaging projection is consisted of at least part of outer wall of outer annular recess along the axis formed along entire periphery of the male part. The peripheral projection thus formed is stable in shape and engaging function, and the male part can be engaged with the female part at any position. Therefore, the male and female parts are reliably engaged.

The groove formed in the peripheral surface of the engaging portion of the female part breaks at a part of the outer periphery of the engaging portion where a land is formed. Ends of the land and opening ends of the annular spring define gaps.

These gaps serve to release the engagement of the annular spring of the snap-fastener having the above-described structure and being in the locked condition. A releasing device of the invention includes opener to be inserted into the gaps formed between the land and the open ends of the annular spring, and tapered surfaces formed on the opener. The opener is formed to be in an acute angle toward the axis of the snap-fastener and the annular spring is spread in diameter when the opener is inserted between the ends of the annular spring and the land.

The tapered surface may have any shape as long as the annular spring can be spread enough for the locking projections to release the male part when the opener is inserted longitudinally. One preferred shape of the opener is that its central portion is cut out to provide legs having parallel confronting surfaces, with their outer surfaces formed to be tapered.

It is apparent from the foregoing that the snap-fastener of the invention can be engaged easily but its disengagement can be obtained only by some qualified persons. Therefore, those who can release the locking condition are limited to the ones who can use the releasing device necessary for easily disengage the snap-fastener.

The snap-fastener is suitable for clothes with linings. In such instance, it is possible to remove a part of the clothes by using the releasing device. No extra space is necessary to obtain this advantage, unlike any conventional arrangements. Therefore, the snap-fastener of the invention does not increase the volume of the cloths so much as the user feels.

Further details of the arrangement, advantage and features of the invention will be apparent from the following descriptions.

DETAILED DESCRIPTION OF THE PREFERRED EMBODIMENTS

Embodiments of the invention will now be described in detail with reference to the accompanying drawings.

Figure 1:
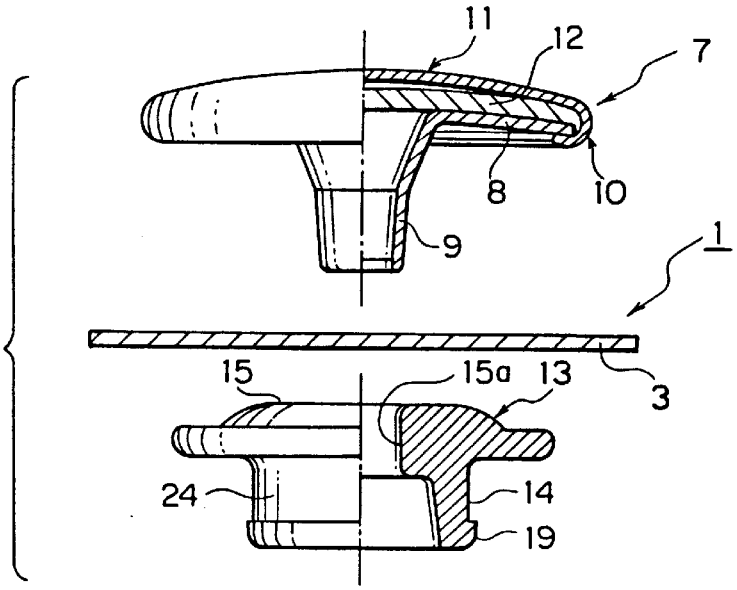
FIG. 1 is an exploded view partly shown in cross-section, of a male member of an embodiment of a snap-fastener according to the invention, before being attached onto a sheet member.
Figure 2:
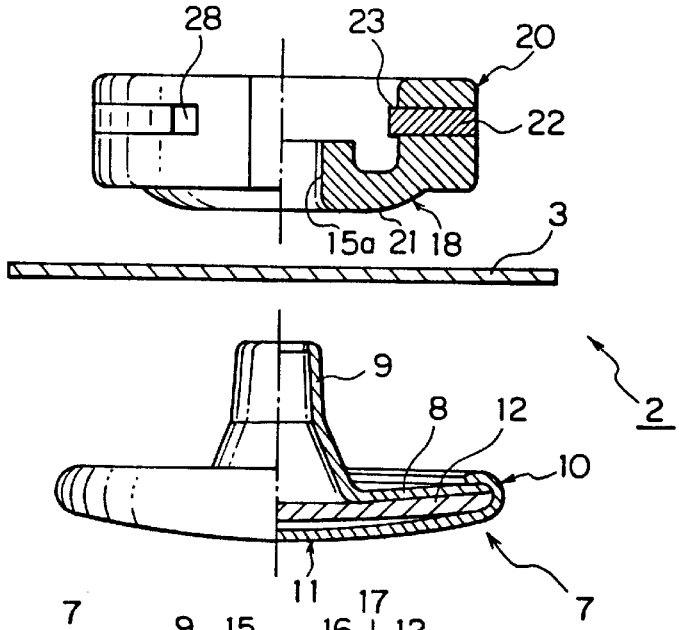
FIG. 2 is an exploded view partly shown in cross-section, of a female member to be engaged and disengaged with the male member.

FIG. 1 shows a male member 1 of a snap-fastener before being assembled, FIG. 2 shows a female member 2 of the snap-fastener before being assembled, and the male member 1 and the female member 2 are attached to a sheet member 3 which is preferably waterproof, and particularly multi-layered.

The male member 1 shown in FIG. 1 includes a cap 7 and a rivet flange 8 which is secured to a cap body 11 as the cap body 11 embraces a peripheral edge of the circular and flat rivet flange 8, which extends substantially perpendicularly from an end of a rivet shaft 9, by rounding a peripheral edge 10 of the cap body 11. The rivet flange 8 and the rivet shaft 9 are respectively made of metal into one piece. As is understood from FIG. 1, the rivet shaft 9 is formed to be hollow and cylindrical, with its distal end being tapered. The end of the rivet shaft 9 is pierced through the sheet member 3 to have a hole there.

A calking plate 12 is inserted between a flange surface of the rivet flange 8 extending from the rivet shaft 9 and the cap body 11 of the cap 7, and is secured between them. The calking plate 12 is composed of a round plastic plate punched and serves as a calking between the cap body 11 and the rivet flange 8.

In the male member 1 of the illustrated example, there provided a male part 13 on the confronting side with respect to the sheet member 3. The male part 13 includes a cylindrical engaging portion 14 and a circular plate 15 projecting like a flange from one end of the engaging portion 14. An insertion-hole 15*a* formed centrally of the circular plate 15 has a diameter smaller than an inside diameter of the engaging portion 14, so as to have a step between an inner surface of the engaging portion 14. In this embodiment, a flange-shaped projection 19 extending outwardly at the end of the engaging portion 14.

The inner diameter of the insertion-hole 15*a* is set to be larger than an outer diameter of the end of the rivet flange 9, and the difference of diameter of the rivet shaft 9 from that of the insertion-hole 15*a* decreases as it goes toward the rivet flange 8. The distal end of the rivet shaft 9 makes a hole as it is pierced through the sheet member 3, and after that the distal end is inserted through the insertion-hole 15*a*. Then the end of the rivet flange 9 is bent to have a flange-shape outwardly along the step formed between the inner circumferential surface of the engaging portion 14, as is understood from FIG. 3.

Figure 3:
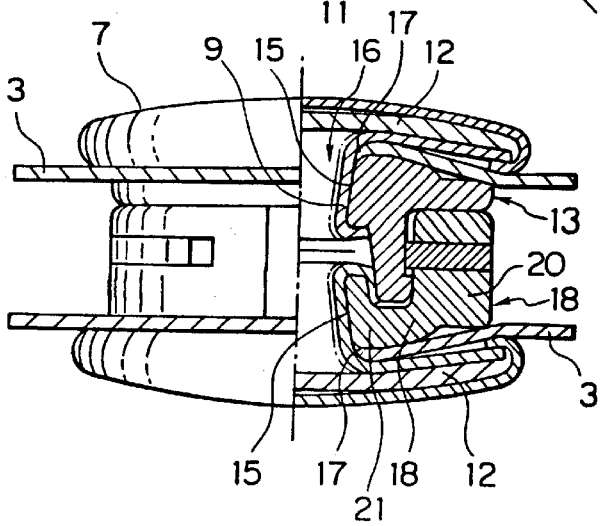
FIG. 3 is a front view partly shown in cross-section, of the male member and the female member finished while being in a locked condition.

FIG. 1 shows the male member 1 before being assembled, whereas FIG. 3 shows a finished male member 1 in which the cap 7 with the rivet shaft 9 is assembled with the male part 13 and which is attached to the sheet member 3. After piercing the sheet member 3 with the rivet shaft 9, a hole 16 is formed in the sheet member 3 as is understood from FIG. 3. After piercing through the sheet member 3, the end of the rivet shaft 9 is secured onto the male part 13 in an usual manner.

As mentioned above, there is a difference in diameter between the insertion-hole 15*a* of the male part 13 and the rivet shaft 9, and an outer surface of the rivet shaft 9 and the inner surface of the insertion-hole 15*a* are fitted water-tight. Further, as an edge of the hole 16 in the sheet member 3, especially its waterproof film is pressed between the rivet shaft 9 and the insertion-hole 15*a* of the male part 13, a seal portion 17 is formed, which prevents water from soaking inside. As can be seen from FIG. 3, when the rivet shaft 9 is inserted through the insertion-hole 15*a*, the peripheral edge of the hole 16 is made to have a wedge-shaped cross section as deformed at the seal portion 17. FIG. 2 shows the female member 2 of the snap-fastener. A cap 7 of the female member 2 has a structure substantially identical with the cap 7 of the male member 1. Therefore, the cap 7 is designated by the reference numeral same as FIG. 1.

Meanwhile, a female part 18 to be integral, with the sheet member 3 sandwiched therebetween, includes a cylindrical male-part-engaging portion 20 and a flange 21 having an L-shaped cross section and extending inwardly from one end of the male-part-engaging portion 20. An engaging space is defined between the male-part-engaging portion 20 and an inner side of the flange 21, for engaging with the projection 19 of the male member 1. From inner diameter side of the flange 21 to a portion standing along the axis forms an insertion-hole 15*a* for inserting a rivet shaft 9 of the cap 7.

A groove 28 is formed on a periphery of the cylindrical male-part-engaging portion 20 along its almost entire periphery, in which a resilient engaging member 22 is fitted from outside. In the illustrated example, the resilient engaging member 22 is composed of an annular spring with part open. In FIGS. 2 and 3, the engaging portion 20 for the male part 13 is schematically shown. Confronting open ends 31 of the annular spring (resilient engaging member 22) have slanting surfaces 34 of acute angle outwardly. The groove 28 breaks at a position where a land 35 is formed, which has end surfaces in peripheral direction are parallel to each other. When the resilient engaging member 22 is fitted in the groove 28, gaps are formed between the ends 31 and the land 35.

Figure 5:
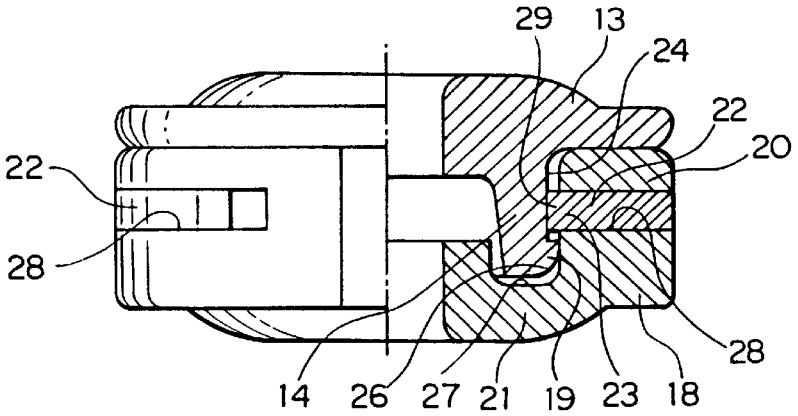
FIG. 5 is a cross-sectional view of the snap-fastener along line V—V of FIG. 4 when being engaged with the male mamber.
Figure 6:
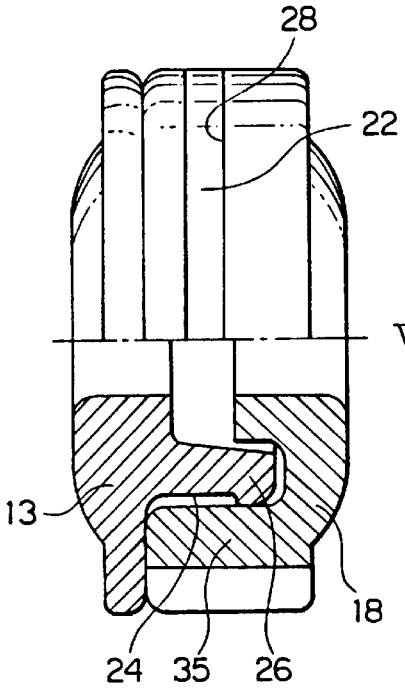
FIG. 6 is a cross-sectional view of the snap-fastener along line VI—VI of FIG. 4.
Figure 4:
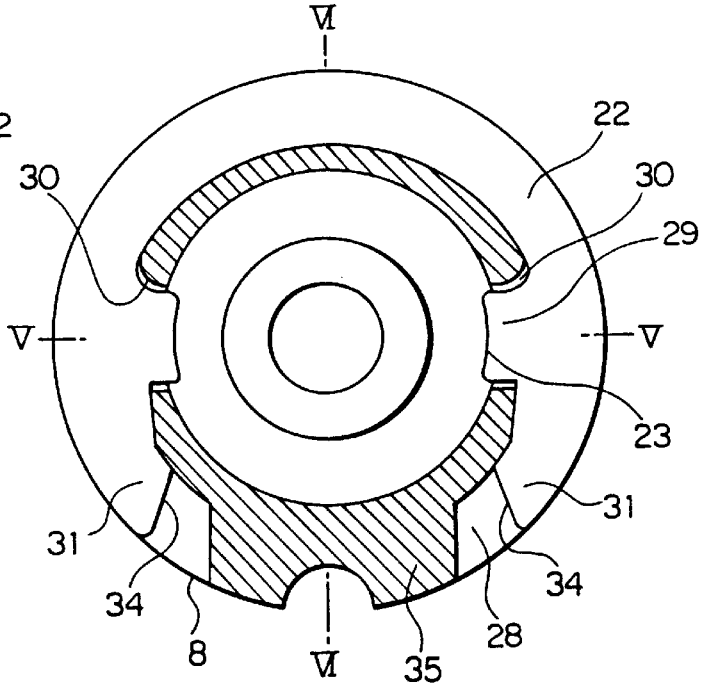
FIG. 4 is a plan cross-sectional view centrally of the female member before being attached to the sheet member.

As is apparent from FIGS. 4 through 6, the above described resilient engaging member 22 is disposed in the engaging portion 20 of the female part 18 for keeping the male part 13 fitted in the female part 18. As is understood from FIGS. 5 and 6, the male part 13 has the projection 19 at the distal end of the engaging portion 14 projecting outwardly in diameter direction. The resilient engaging member 22 composed of a resilient spring and fitted in the groove 28 formed in the peripheral surface of the male-part-engaging portion 20 has locking projections 23 projecting toward the center. The locking projections 23 restrict movement of the engaging projections 19 of the male part 13 projecting outwardly in diameter direction, along the axis. Slits 30 are formed at the bottom of the groove 28 so that the locking projections 23 can project from the inner surface of the male-part-engaging portion 20 toward the axis.

According to the illustrated example, the engaging projection 19 is defined by an outer annular recess 24 formed in the engaging portion 14 of the male part 13. Namely, the engaging projection 19 is formed by a wall along the axis at the end of the outer annular recess 24. Therefore, the engaging projection 19 extends in a flange shape along the entire periphery of the engaging portion 14. Merely by exerting pressure in the axial direction onto the male part 13 with respect to the female part 18, the engaging projection 19 presses the locking projections 23 outwardly from inside and moves over the locking projections 23 while resiliently deforming the resilient engaging member 22 outwardly against the resilience. As the resilient engaging member 22 resiliently restores its original shape, the engaging projection 19 engages with the locking projections 23. To facilitate moving over the resilient engaging member 22 which resiliently deforms, an outer edge 26 of the engaging projection 19 is formed to have an arcuate cross-section.

As shown in FIGS. 4 through 6, the outer edge 26 is received in an annular groove 27 formed between the engaging portion 14 of the female part 18 and the inner flange 21. Thus, as shown in FIG. 5, when the male part 13 and the female part 18 are assembled, the engaging projection 19 is guided by the annular groove 27 axially and concentrically. The annular groove 27 serves to stabilize the engagement of the male member 1 and the female member 2 without being quite deep.

In order to release the male part 13 from the female part 18, the locking projections 23 projecting inwardly of the resilient engaging member 22 are pushed outwardly against the resilience of the resilient engaging member 22 so that the engagement of the locking projections 23 with the engaging projection 19 of the male part 13 is released. Thus the male member 1 and the female member 2 are separated easily.

FIGS. 4 and 5 show that an annular spring serving as the resilient engaging member 22 with the locking projections 23 has front and rear surface which are perpendicular to the axis of the snap-fastener. The groove 28 formed in the periphery of the female part 18 for accommodating the annular spring 22 has one width unchanged along almost entire periphery of the male-part-engaging portion 20. The width corresponds to the thickness of the annular spring 22 to be fitted in the groove 28. The annular spring 22 has the locking projections 23 in confronting relationship in the inner surface thereof.

When the annular spring 22 is fitted in the groove 28, the locking projections 23 project through the slits 30 formed in the groove 28, with distal ends 29 thereof projecting into the engaging space of the male-part-engaging portion 20. The distal ends 29 project into the annular recess 24 formed in the peripheral surface of the cylindrical engaging portion 14 of the male part 13. In the state shown in FIG. 5, axial movement of the projection 19 formed peripherally at the end of the engaging portion 14 of the male part 13 is restricted.

When the ends 31 of the annular spring 22 is pressed peripherally, the annular spring 22 is deformed resiliently, and the distal ends 29 as well as the locking projections 23 slide outwardly from the annular recess 24 of the male part 13 so as to be released from the female part 18. For this releasing action, an exclusive device is used.

Figure 7:
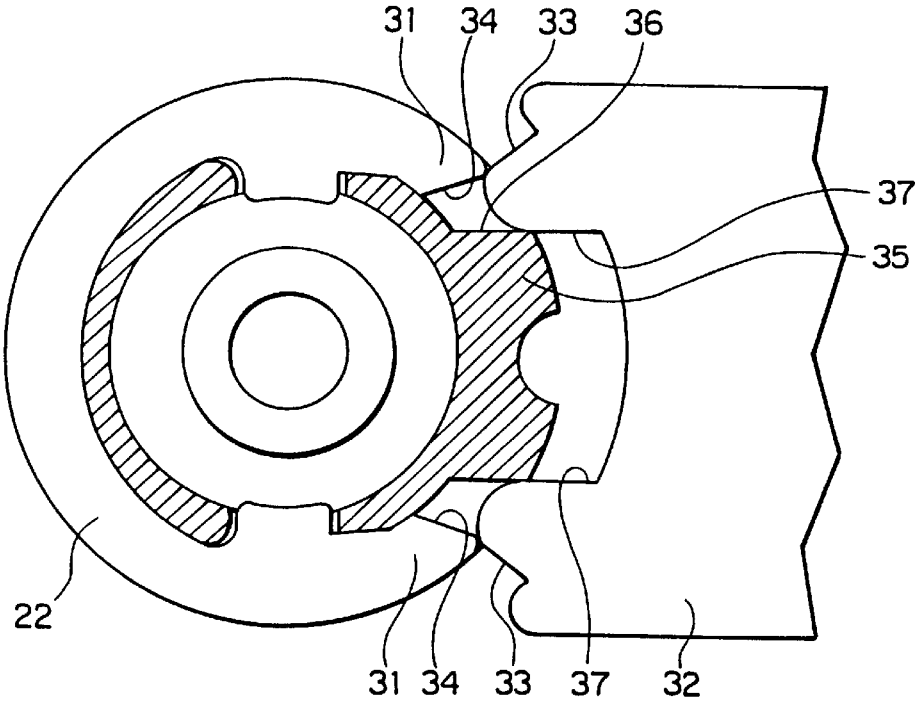
FIG. 7 is a plan cross-sectional view of the female member of FIG. 4 at the beginning of insertion of a releasing device.
Figure 8:
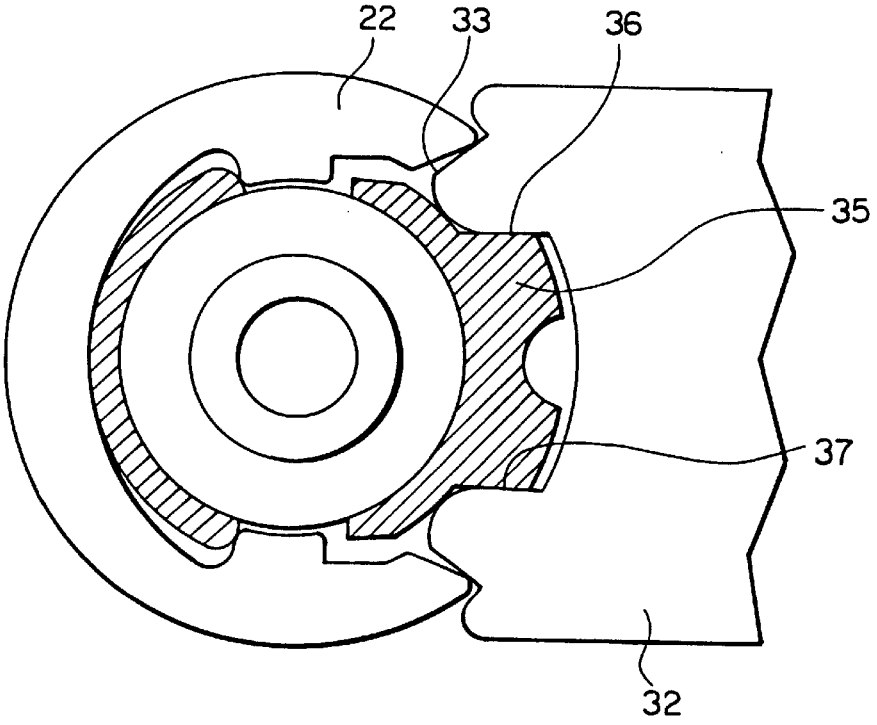
FIG. 8 is a plan cross-sectional view of the female member and the releasing device when the releasing device of FIG. 4 is inserted.

FIGS. 7 and 8 show an embodiment of the releasing device of the invention and operation to separate the male part 13 and the female part 18 using the device.

The releasing device is in a shape of a flat opener 32 which can be inserted into the gaps between the ends 31 of the annular spring 22 and the land 35 which has been formed by breaking the groove 28. The thickness of the opener 32 is slightly smaller than that of the annular spring 22. In the illustrated example, the opener 32 has side surfaces 33 at the front side in insertion direction which converge at an acute angle. By adjusting this angle properly, the insert action of the opener 32 can be transformed to an action to spread the diameter of the annular spring 22. Referring to FIG. 8 together with FIG. 5, it can be understood that the operation of spreading the diameter of the annular spring 22 results in that the engagement between the distal ends 29 of the locking projections 23 and the peripheral engaging projection 19 of the male part 13 is disengaged. One or both of the surfaces 34 of the confronting ends 31 of the annular spring 22 and outer surfaces 33 of the opener 32 which contact the surfaces 34 are preferably tapered in order to secure spreading of the ends 31 of the annular spring 22.

As can be seen from FIGS. 7 and 8, the surfaces of the land 35 formed to break the peripheral groove 28 defined to accommodate the annular spring 22 on which the opener 32 of the releasing device slide are formed to be boundary surfaces 37 parallel with each other.

I claim:

1. A snap-fastener comprising:

(a) a male member including a male part and a cap having a rivet shaft which is pierced through a sheet member; and (b) a female member including a female part and a cap having a rivet shaft which is pierced through a sheet member;

wherein each of said rivet shaft is inserted into an insertion-hole of said male part or said female part via an inner edge of a hole of the sheet member and is press-deformed to be integral with said male part or said female part;

wherein said male part includes an engaging portion extending in axial direction and having at least an engaging projection projecting outwardly in diameter direction at a distal end thereof;

wherein said female part includes a male-part-engaging portion extending substantially axially and having a resilient engaging member to be in locking engagement with said engaging projection;

wherein said resilient engaging member of said female part is fitted in a groove formed in a periphery of the female part from outside and has locking projections projecting inwardly in diameter direction of the male-part-engaging portion;

wherein said engaging projection of said male part engages with said locking projections so as to be restricted in movement in axial direction; and wherein said locking projections are resiliently movable outwardly so as to release said male part by urging said resilient engaging member in direction of outer diameter.

2. A snap-fastener according to claim 1, wherein said groove is formed along almost entire periphery of said female part and has a width enough to insert said resilient engaging member therein;

wherein said resilient engaging member is composed of an annular spring with a part open and is guided toward an axis of the snap-fastener as being inserted in said groove;

wherein said annular spring has at least a locking projection projecting in inner diameter direction; and wherein said groove has at least a slit through which said locking projection projects in axial direction from a inner surface of said male-part-engaging portion.

3. A snap-fastener according to claim 2, wherein said resilient spring has two locking projections, said engaging projections of said male part are provided in confronting relationship, and said engaging projections are locked by engaging with said locking projections.

4. A snap-fastener according claim 3, wherein said engaging projection is composed of at least part of an outer wall extending axially, of an outer annular recess formed all the way round said male part.

5. A snap-fastener according to claim 4, wherein confronting ends of said annular spring defined by an opening of said annular spring move temporarily in outer diameter direction as the annular spring is deformed by an outer force, so that said locking projections are disengaged from said engaging projections of the male part and hence the male part can be in released condition.

6. A snap-fastener according to claim 5, wherein said groove breaks with a land formed at a part of an outer periphery of said male-part-engaging portion, and gaps are formed between said land and ends of said annular spring.

7. A releasing device to release locking condition of the snap-fastener according to claim 6, comprising:

(a) an opener insertable between said ends of said annular spring and said land; and (b) tapered surfaces formed on said opener;

wherein said opener is formed to be in an acute angle toward the axis of the snap-fastener; and wherein said annular spring is spread in diameter when said opener is inserted between said ends of said annular spring and said land.

8. A releasing device according to claim 7, wherein a central portion of said opener is cut out and confronting surfaces of the cut-out are parallel with each other.

9. A snap-fastener according claim 2, wherein said engaging projection is composed of at least part of an outer wall extending axially, of an outer annular recess formed all the way round said male part.

10. A snap-fastener according to any one of claims 2, 3 or 9, wherein confronting ends of said annular spring defined by an opening of said annular spring move temporarily in outer diameter direction as the annular spring is deformed by an outer force, so that said locking projections are disengaged from said engaging projections of the male part and hence the male part can be in released condition.

11. A snap-fastener according to claim 10, wherein said groove breaks with a land formed at a part of an outer periphery of said male-part-engaging portion, and gaps are formed between said land and ends of said annular spring.

12. A releasing device to release locking condition of the snap-fastener according to claim 11, comprising:

(a) an opener insertable between said ends of said annular spring and said land; and (b) tapered surfaces formed on said opener;

wherein said opener is formed to be in an acute angle toward the axis of the snap-fastener; and wherein said annular spring is spread in diameter when said opener is inserted between said ends of said annular spring and said land.

13. A releasing device according to claim 12, wherein a central portion of said opener is cut out and confronting surfaces of the cut-out are parallel with each other.

14. A snap-fastener according to claims 1 or 2, wherein said groove breaks with a land formed at a part of an outer periphery of said male-part-engaging portion, and gaps are formed between said land and ends of said annular spring.

15. A releasing device to release locking condition of the snap-fastener according to claim 14, comprising:

(a) an opener insertable between said ends of said annular spring and said land; and (b) tapered surfaces formed on said opener;

wherein said opener is formed to be in an acute angle toward the axis of the snap-fastener; and wherein said annular spring is spread in diameter when said opener is inserted between said ends of said annular spring and said land.

16. A releasing device according to claim 15, wherein a central portion of said opener is cut out and confronting surfaces of the cut-out are parallel with each other.

* * * * *